US006092664A

United States Patent [19]

Bartosek

[11] Patent Number: 6,092,664

[45] Date of Patent: Jul. 25, 2000

[54] FOOD PACKAGE INCLUDING A TRAY

[76] Inventor: Paul Bartosek, 55 Franklin Street North, Kitchener, Ontario, Canada, N2A 1Y1

[21] Appl. No.: 09/148,307

[22] Filed: Sep. 4, 1998

[30] Foreign Application Priority Data

Sep. 10, 1997 [CA] Canada ..... 2215873

[51] Int. Cl.[7] ..... B65D 75/00; B65D 5/50

[52] U.S. Cl. ..... 206/784; 229/103.2; 229/902; 426/120

[58] Field of Search ..... 206/525, 784; 229/103.2, 102, 125.35, 902, 903, 905, 906; 426/119, 120, 112

[56] References Cited

U.S. PATENT DOCUMENTS

| | | |
|---|---|---|
| D. 184,633 | 3/1959 | Meagher . |
| D. 214,075 | 5/1969 | Pregont . |
| D. 214,459 | 6/1969 | Stageberg . |
| D. 216,869 | 3/1970 | Britt . |
| D. 218,927 | 10/1970 | Artz . |
| D. 224,206 | 7/1972 | Cyr et al. . |
| D. 224,585 | 8/1972 | Jewell . |
| D. 224,586 | 8/1972 | Jewell . |
| D. 265,551 | 7/1982 | Colby et al. . |
| D. 268,645 | 4/1983 | Phillips et al. . |
| D. 271,932 | 12/1983 | Mosley . |

(List continued on next page.)

FOREIGN PATENT DOCUMENTS

| | | |
|---|---|---|
| 2072022 | 6/1991 | Canada . |
| 2054670 | 5/1992 | Canada . |
| 273 840 | 7/1988 | European Pat. Off. . |
| 441 666 | 8/1991 | European Pat. Off. . |
| 2 553 215 | 4/1985 | France . |
| 3110847 | 9/1982 | Germany . |

OTHER PUBLICATIONS

Modern Packaging, "Smart Cookies" Ad, Jan., 1953, p. 146.
Neue Verpackaging Magazine, Cover, Mar., 1986.
Neue Verpackaging Magazine, Cover, Jul., 1987.
Oscar Mayer Introduces . . . Breakfast Packs, 1987.
Oscar Mayer Introduces . . . Deluxe Meat Salads, 1988.
Oscar Mayer Introduces . . . Heat & Serve Breakfast for One, 1986.
Oscar Mayer Introduces . . . Little Oscar's Lunch Fixings, 1986.
Oscar Mayer Introduces . . . Little Oscar's Lunch Pack, 1986.
Oscar Mayer Introduces . . . Lunch Packs, 1988.

*Primary Examiner*—Bryon P. Gehman
*Attorney, Agent, or Firm*—Nixon & Vanderhye P.C.

[57] ABSTRACT

The present invention is a food package comprising, in combination, a tray, a collar, and an anchor to resist slideable displacement of the collar relative to the tray. The tray has a plurality of open top food compartments, and, in plan view, is substantially rectangular with a top planar surface defining perimeter edges about the tray and borders between top openings of the compartments. Each compartment has bottom and side surfaces, the bottom surfaces lying substantially in a bottom plane parallel to the top surface of the tray, the sides of adjacent compartments being separated by predetermined spaces. The collar surrounds the tray over the top surface, about a first perimeter edge of the top surface, covering the sides and bottom surfaces of at least a portion of two adjacent compartments and about a second perimeter edge opposite to the first perimeter edge. The anchor is pressed from the collar into a space between the sides of two adjacent compartments to resist slideable displacement of the collar relative to the tray. In a preferred embodiment of this invention the collar also has an integral stand to support the package upright on it's edge with the top surface in a substantially vertical plane. For example, in an embodiment where the collar begins as a strip which is wrapped about the tray, the strip ends may overlap at the joint with an outside end extending from the joint to form a tab. The joint may be placed close to the perimeter of the bottom plane so that the extending tab can act with the corresponding edge of the top surface to support the package upright on its edge.

13 Claims, 4 Drawing Sheets

U.S. PATENT DOCUMENTS

D. 273,842 5/1984 Jeannin .
D. 276,201 11/1984 Wolff .
D. 280,290 8/1985 Bakus .
D. 282,821 3/1986 Noyes .
D. 283,666 5/1986 Holzkopf .
D. 286,618 11/1986 Kea et al. .
D. 286,745 11/1986 Forbes, Jr. .
D. 290,582 6/1987 Angerman .
D. 302,068 7/1989 Forbes, Jr. et al. .
D. 305,204 12/1989 Reifein et al. .
D. 305,205 12/1989 Grindrod et al. .
2,904,170 9/1959 Hennessey et al. ..... 206/784
2,950,040 8/1960 Bolding .
2,965,501 12/1960 Harriss .
3,037,677 6/1962 Debs .
3,067,925 12/1962 Gillam .
3,115,245 12/1963 Schechter .
3,197,058 7/1965 Hale .
3,224,618 12/1965 Vigue .
3,292,810 12/1966 Schechter .
3,372,856 3/1968 Erhart et al. .
3,373,045 3/1968 Peterson .
3,401,863 9/1968 Earl .
3,411,696 11/1968 Ayer et al. ..... 206/784 X
3,443,681 5/1969 Wysocki .
3,451,612 6/1969 Sinoto .
3,487,915 1/1970 Scott .
3,586,234 6/1971 Nathan et al. .
3,604,560 9/1971 Farquhar ..... 206/784
3,618,848 11/1971 Pawlowski et al. ..... 206/784
3,637,404 1/1972 MacManus ..... 206/784 X
3,651,928 3/1972 Weisman .
3,759,720 9/1973 Young .
3,765,529 10/1973 Mueller ..... 206/784 X
3,773,247 11/1973 Mueller .
3,785,546 1/1974 Kuster .
3,796,366 3/1974 Hahn .
3,874,548 4/1975 Buff, Jr. .
3,903,309 9/1975 Mahaffy et al. .
3,933,296 1/1976 Ruskin et al. .
4,007,828 2/1977 Mayled .
4,013,798 3/1977 Goltsos .
4,058,211 11/1977 Barbieri et al. .
4,114,760 9/1978 Entenmann .
4,146,128 3/1979 Hogg et al. .
4,202,465 5/1980 McLaren .
4,221,320 9/1980 Faller .
4,233,367 11/1980 Ticknor et al. .
4,240,522 12/1980 Spear et al. .
4,240,552 12/1980 Brown .
4,313,540 2/1982 Hart et al. ..... 206/784 X
4,346,833 8/1982 Bernhardt .
4,355,721 10/1982 Knott, II et al. .
4,355,755 10/1982 Faller .
4,382,513 5/1983 Schirmer et al. .
4,382,613 5/1983 Haupt .
4,405,667 9/1983 Christensen et al. .
4,444,827 4/1984 Swaroop .
4,537,305 8/1985 Takanashi .
4,570,818 2/1986 Borst et al. .
4,574,174 3/1986 McGonigle .
4,588,078 5/1986 Ferrero .
4,669,611 6/1987 Flaherty .
4,671,453 6/1987 Cassidy .
4,674,633 6/1987 Steadman .
4,701,360 10/1987 Gibbons et al. .
4,821,884 4/1989 Griffin et al. .
4,836,380 6/1989 Walter et al. .
4,944,603 7/1990 Cornish et al. .
4,961,494 10/1990 Alexander .
5,011,006 4/1991 Anderson .
5,042,652 8/1991 Grindrod .
5,119,940 6/1992 Grindrod .
5,123,527 6/1992 Hustad ..... 229/902 X
5,197,657 3/1993 Cassidy et al. ..... 229/103.2 X
5,375,701 12/1994 Hustad et al. .
5,588,587 12/1996 Stier et al. ..... 229/903 X

FOOD PACKAGE INCLUDING A TRAY

FIELD OF THE INVENTION

This invention relates to packages, and, in particular, to a food tray having a surrounding collar that enables the package to stand upright on an edge.

BACKGROUND OF THE INVENTION

There are many different kinds of food packages, but of particular relevance to this disclosure are food packages of a type generally comprising a plastic tray formed with adjacent but separate compartments, each such compartment having a top opening for receiving a different food product and all of the openings of such compartments being covered by a thin flexible film. An example of such a tray is shown in U.S. Pat. No. 4,013,798.

Sometimes trays of this type are put in boxes, some are fitted with rear panels and others are surrounded by a collar. These devices serve the purpose of providing a substrate for written product information and advertising, of providing protection for the tray during handling, and sometimes providing a means for having the tray stand upright for display on a shelf. U.S. Pat. No. 5,042,652 shows a stiff collar wrapped around the tray sufficiently tightly that it will not slide off the tray due to frictional engagement between the collar and the tray.

SUMMARY OF THE PRESENT INVENTION

The present invention is a food package comprising, in combination:

- a tray having a plurality of open top food compartments, the tray being, in plan view, substantially rectangular and having a top planar surface defining perimeter edges about the tray and borders between top openings of the compartments, each such compartment having bottom and side surfaces, the bottom surfaces lying substantially in a bottom plane parallel to the top surface of the tray, the sides of adjacent compartments being separated by predetermined spaces;
- a collar surrounding the tray over the top surface, about a first perimeter edge of the top surface, covering the sides and bottom surfaces of at least a portion of two adjacent compartments and about a second perimeter edge opposite to the first perimeter edge; and
- an anchor which may be pressed from the collar into a space between the sides of two adjacent compartments to resist slideable displacement of the collar relative to the tray.

The tray of this invention will usually be made from a sheet of plastic out of which the compartments are formed. The sides of the compartments will depend downward from the top surface and narrow towards one another as they approach the bottom of the compartment. Thus the space between adjacent compartment sides will usually be larger near the bottom of the compartments and attenuate towards the top surface of the tray. Thus an anchor will be frictionally engaged with greater force as the anchor is pressed further into the attenuating shape of the space between adjacent food compartments.

In a preferred embodiment, the collar is constructed from a carton blank. The carton blank may be generally rectangular or have other, even fanciful shapes, as may be appropriate to an attractive appearance and to provide advertising and product information space. The collar has a top panel extending over the top surface between opposed edges of the tray, a pair of side panels extending down over a portion of the sides of the food compartments, and a bottom panel across the bottom of the tray. The collar may begin as a lineal strip with first and second ends. The collar may then be wrapped about the tray to bring the ends together to be fastened at a joint.

In a preferred embodiment where the collar is made of cardboard or the like, the anchor may be a stiff, cut-out tab which extends inwardly of the collar into a space or channel between adjacent compartments.

In a preferred embodiment of this invention the collar also has an integral stand to support the package upright on it's edge with the top surface in a substantially vertical plane. For example, in an embodiment where the collar begins as a strip which is wrapped about the tray, the strip ends may overlap at the joint with an outside end extending from the joint to form a tab. The joint may be placed close to the perimeter of the bottom plane so that the extending tab can act with the corresponding edge of the top surface to support the package upright on its edge.

BRIEF DESCRIPTION OF THE DRAWING FIGURES

For a better understanding of the present invention and to show more clearly how it may be carried into effect, reference will now be made, by way of example, to the accompanying drawings, which show a preferred embodiment of the present invention and in which.

DESCRIPTION OF PREFERRED EMBODIMENT

Figure 8:
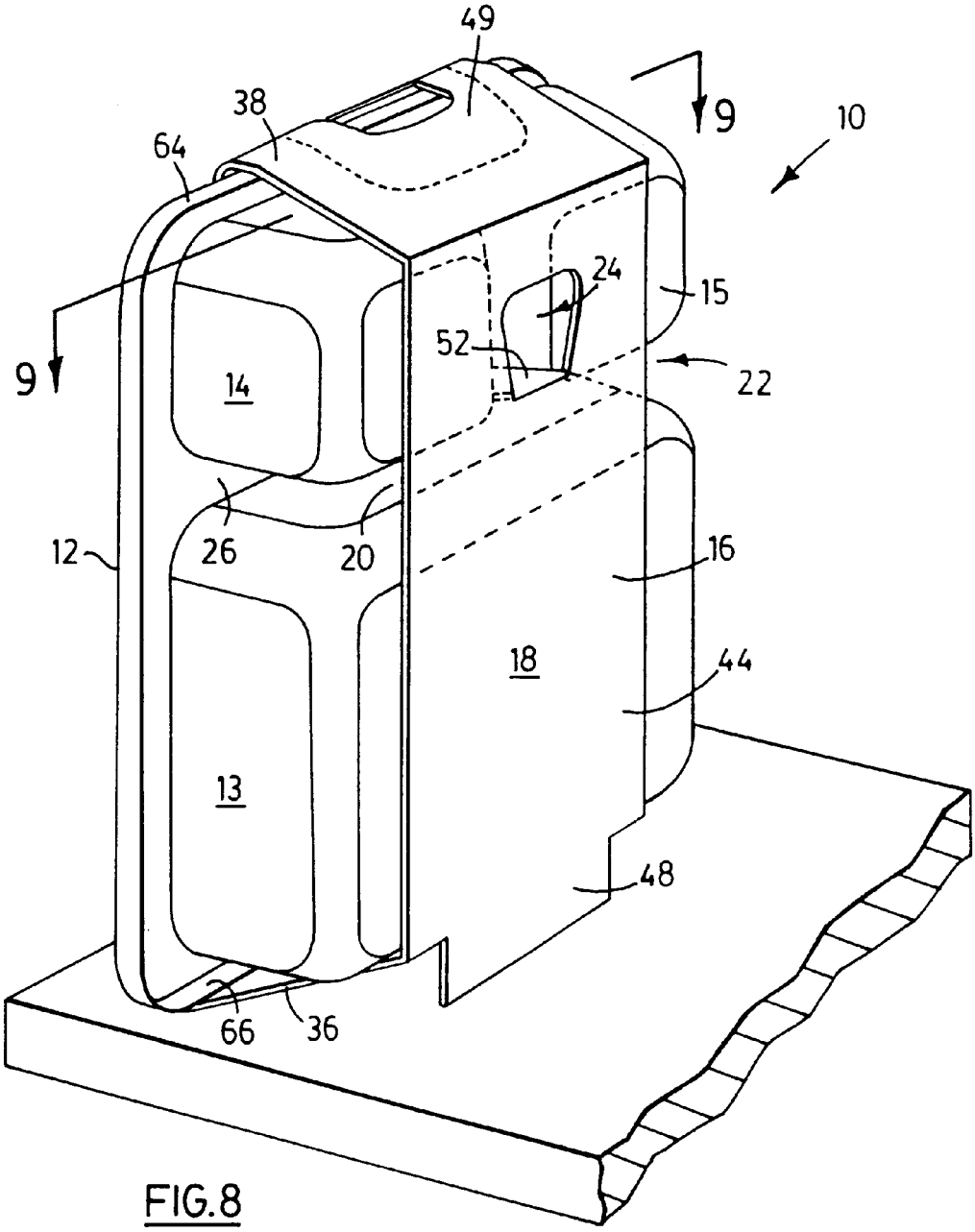
FIG. 8 is a rear perspective view of the package comprising the collar and tray and showing the preferred embodiment of the anchor.

FIG. 8 illustrates the package 10 for a food product of this invention, comprising a tray 12, having a plurality of recessed compartments 14 for receiving a product, such as food, a collar 16 comprising a body 18 having a cavity 20 therewithin of a size and configuration to slideably receive tray 12, an access opening 22 to cavity 20 through which tray 12 can be slideably inserted, and an anchor 24 to secure collar 16 against further slideable displacement relative to tray 12, as will hereinafter be described.

Figure 9:
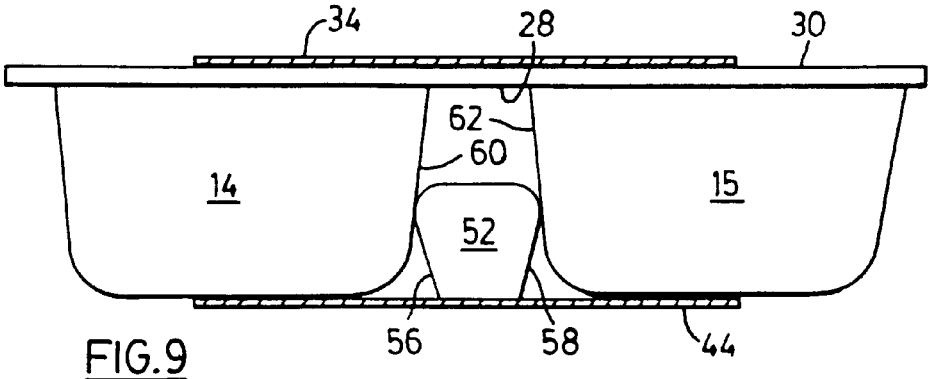
FIG. 9 is a cross-sectional view taken along the lines 9—9 of FIG. 8 illustrating the preferred embodiment of the anchor.

In the preferred embodiment tray 12 is formed of a single piece of plastic material, such as high impact polystyrene, acrylonitrile copolymers, polyesters, polypropylene, polyvinylchloride, or polyester copolymers. The tray comprises a plurality of compartments 13, 14, and 15, which are recessed a sufficient depth to receive the product. Horizontal channel 26 separates compartment 13 from compartments 14 and 15, while vertical channel 28 separates compartments 14 and 15 from one another. The sides of the compartments will depend downward from the top surface and narrow towards one another as they approach the bottom of the compartment. Thus the space between adjacent compartment sides will usually be larger near the bottom of the compartments and attenuate towards the top surface of the tray, see FIG. 9. Thus an anchor will be frictionally engaged with greater force as the anchor is pressed further into the attenuating shape of the space between adjacent food compartments, as will hereinafter be explained.

The preferred function of the tray of this invention is to provide a selection of foods which when taken together form a snack eaten by a consumer at one time. Typically, such a tray has all compartments of the same depth and sufficiently spaced apart so that it will sit in a stable manner on a table when in use. To ensure freshness the compartments are covered with a thin, flexible, and preferably transparent, film 30. The film is preferably a multilayer film with one layer preferably a polyester, nylon, polypropylene, or polyethylene, while the other layer is an adhesive layer containing an antifogging additive or coating. The film may also contain an oxygen barrier such as saran ethylene vinyl alcohol. The film is heat sealed or secured to the tray by ultrasonic sealing, all as is well known in the industry.

Figure 1:
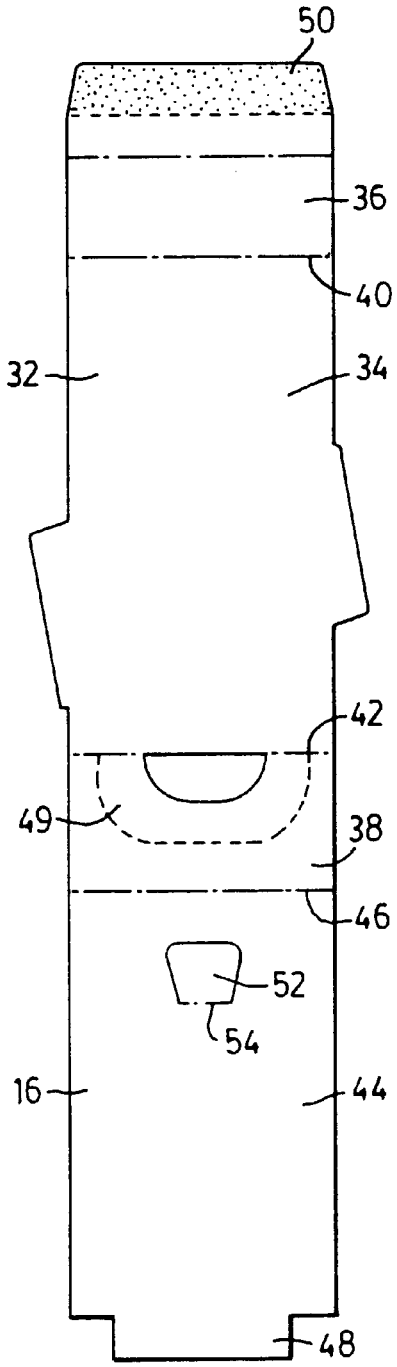
FIG. 1 is a plan view of a blank used to form the collar for a package for a food product.
Figure 2:
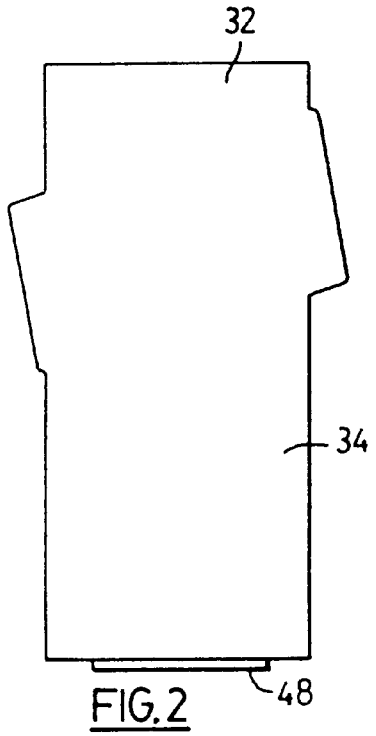
FIG. 2 is a front plan view of the collar assembled from the blank of FIG. 1.
Figure 3:
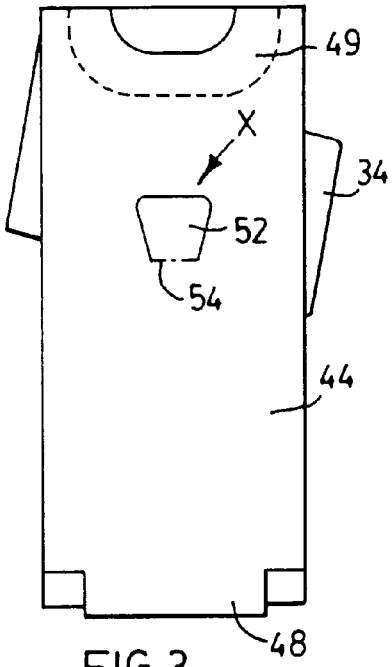
FIG. 3 is a rear plan view of the collar assembled from the blank of FIG. 1.
Figure 4:
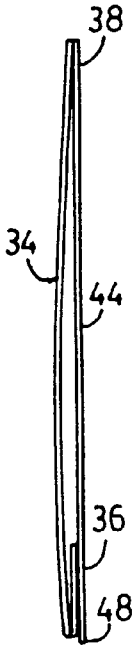
FIG. 4 is a side view of the collar assembled from the blank of FIG. 1 but collapsed.
Figure 5:
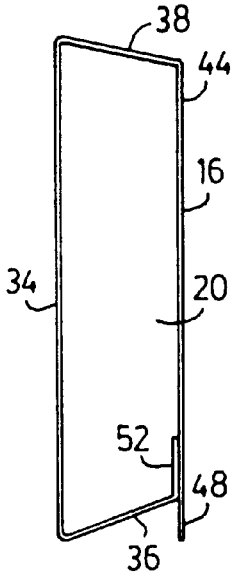
FIG. 5 is a side view of the collar assembled from the blank of FIG. 1 but expanded to reveal cavity and access opening through which a tray can slideably be received.

Collar 16 is opaque, relatively stiff but somewhat resilient. A preferred material of construction would be paper board. A carton blank 32 of paper board to form collar 16 is illustrated in FIGS. 1. Carton blank 32 is generally rectangular in shape and generally a lineal strip comprising a top panel 34 of a length taken along the long dimension of the rectangle which is substantially equal to the length L of tray 12, as shown in FIG. 8. A pair of side panels 36 and 38 connect to opposite ends of top panel 34 along fold lines 40 and 42, respectively, and extend in the longitudinal direction of the rectangle a distance greater than the height H of the tray as shown in FIG. 8. A bottom panel 44 is connected to side panel 38 along fold line 46 and extends in the longitudinal direction of the rectangle for a distance less than or equal to the length of top panel 34 but not greater than the distance across the bottom of the tray, as illustrated in FIG. 8. Bottom panel 44 features an edge 48 at the opposite end to side panel 38, which purpose will be hereinafter explained.

Bottom panel 44 is joined to side panel 36 by gluing tab 50, as is well known in the art, to a portion of bottom panel 44 so that collar 16 is formed having cavity 20 therewithin of a size and configuration to slideably receive tray 12 and an access opening 22 to cavity 20 through which tray 12 can be slideably inserted, all as is well known in the art. It can be appreciated that in the preferred embodiment collar 16 snugly wraps tray 12. In the manufacture of the package the collar is generally wrapped around the tray with bottom panel 44 glued to side panel 36 by gluing tab 50.

Figure 6:
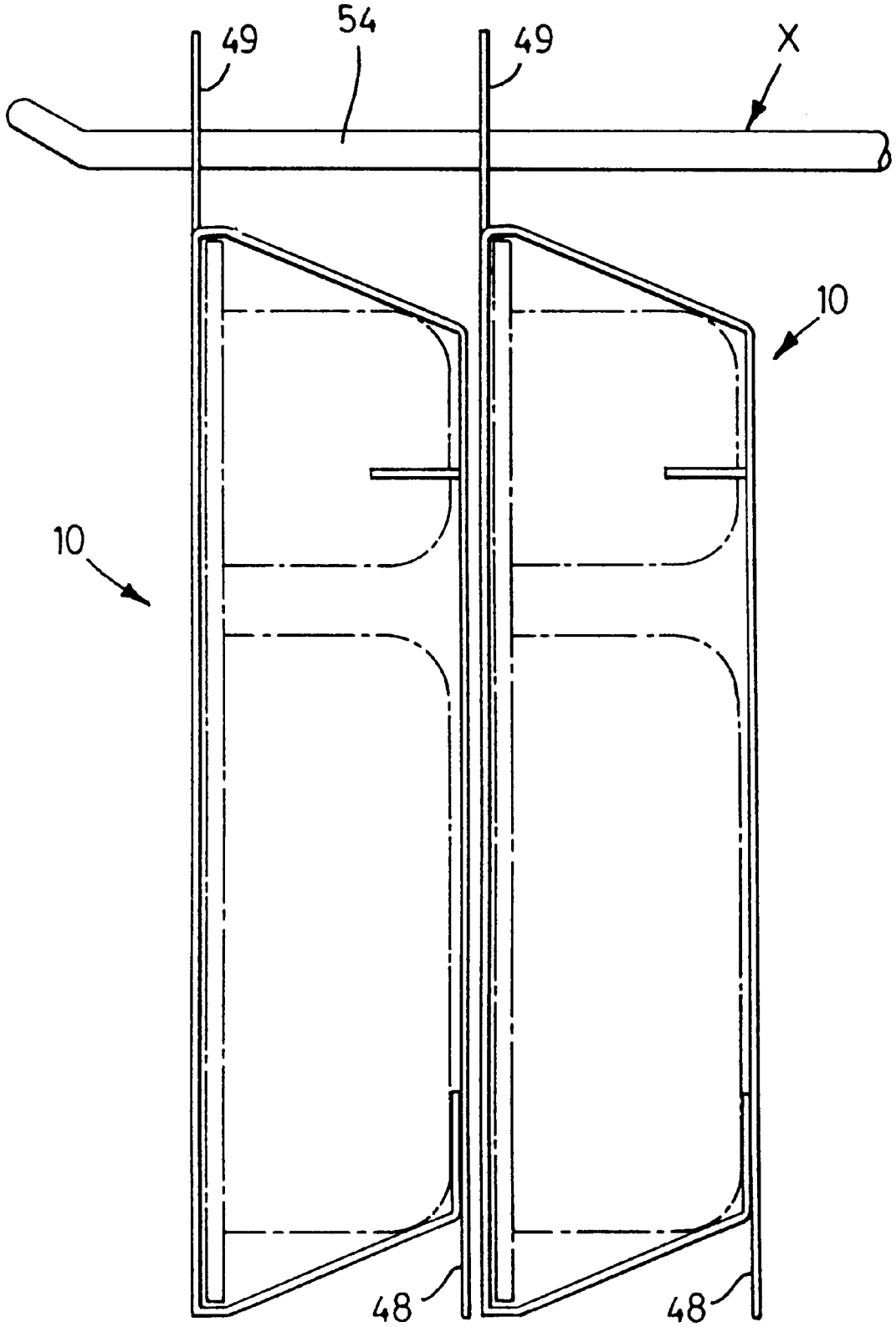
FIG. 6 is a side view of a package comprising the collar and tray.

Blank 32 can also have a cutout 49 presented within side panel 38 to form a handle for supporting package 10 therebelow, as best illustrated in FIG. 6. This handle allows a young consumer to carry the package, or for storing the package in a typical grocery store on hooks 51.

Figure 7:
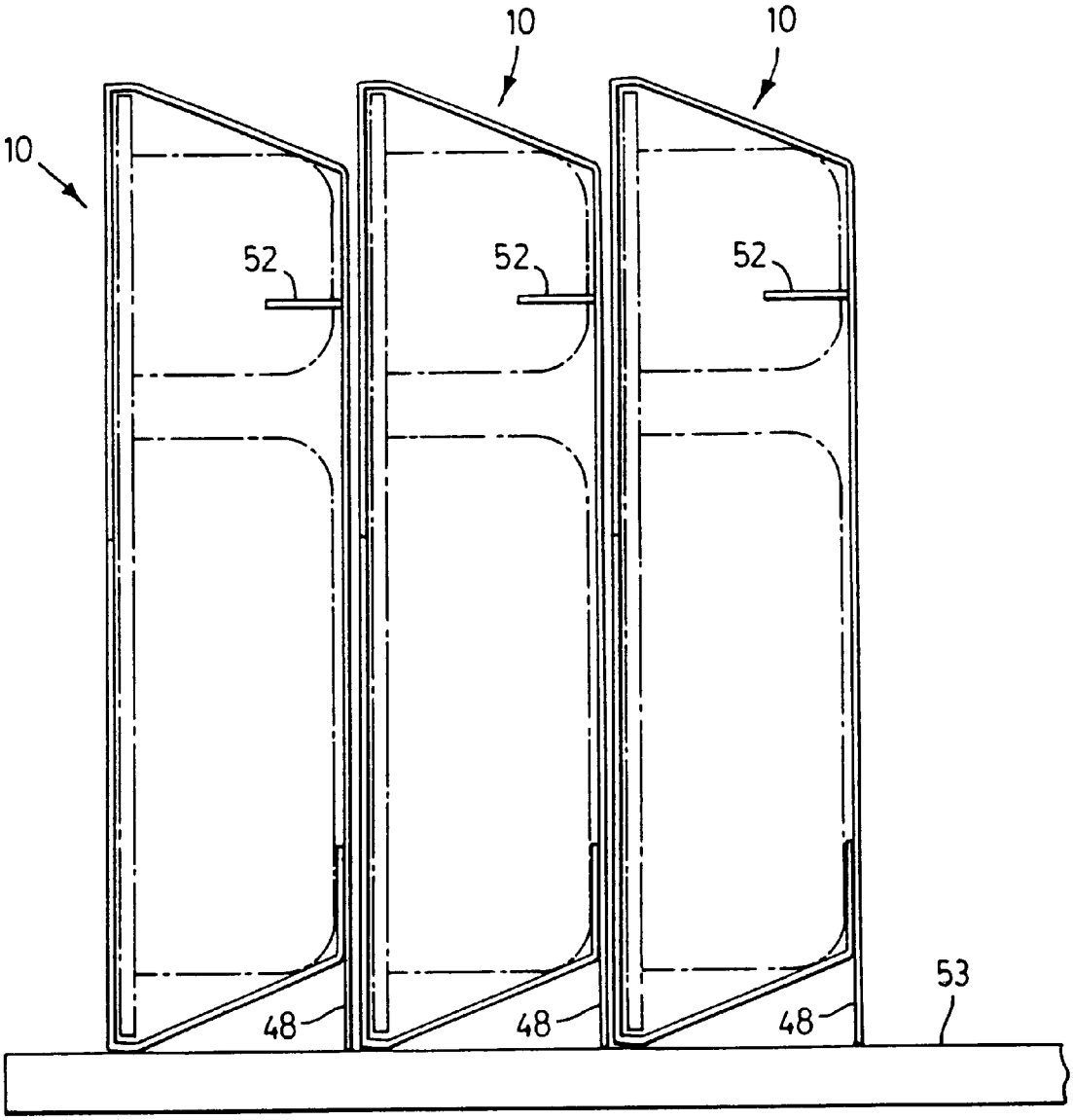
FIG. 7 is an alternative side view of the package comprising the collar and tray.

In FIG. 7 an alternative method of storing package 10 on a shelf 53 is illustrated. Here edge 48 of bottom panel 44 extends downwardly towards shelf 53 to form a stand allowing the packaging to be stored vertically on a shelf, all as is well known in the art.

In the preferred embodiment of this invention anchor 24 comprises a locking means or tab 52 presented by collar 16, and a receiving means or vertical channel 28, presented by tray 12. In particular, bottom panel 44 includes a cutout which forms tab 52. Tab 52 is foldable about fold lines 54. Tab 52 should have a width that will enable it to be received in an interference fit within channel 28. Moreover as collar 16 is preferably constructed from relatively stiff paper board, tab 52 is stiff.

In the preferred embodiment of the invention channel 28 extends generally vertically between compartments 14 and 15 of tray 12 and centrally thereof. Similarly, the cutout to form tab 52 is centred about the width of bottom panel 44. It can be appreciated, however, that the lengthwise positioning of tab 52 on bottom panel 44 should be such that when blank 32 is assembled to form collar 16, and tray 12 is slideably inserted within cavity 20 tab 52 substantially overlies vertical channel 28 (see FIGS. 8 and 9).

Accordingly, when tray 12 is received within cavity 20 of collar 16 through access opening 22 such that tab 52 substantially overlies vertical channel 28, tab 52 can be folded about fold line 54 inwardly of cavity 20 and into vertical channel 28 of tray 12. Side edges 56 and 58 of tab 52 engage respective sides 60 and 62 of compartments 14 and 15 of tray 12 securing tray 12 against further slideable displacement.

In the preferred embodiment channel 28 of tray 12 is vertical and tray 12 is slideable within cavity 20 through access opening 22 of collar 16 about an axis 64 parallel to opposed parallel edges 66 and 68 of tray 12. It can be appreciated however that channel 28 does not need to run strictly perpendicular to the axis 64. Various angles transverse to axis 64 can be considered and would be apparent to those skilled in the art: the goal is to have tab 52 extending into engage channel 28 in such a manner that slideable displacement of collar 16 relative to tray 12 is inhibited once the two are properly positioned with respect to one another.

It can also be appreciated that alternatives to tab 52 and channel 28 can be constructed by those skilled in the art. Consider, for example, an embodiment wherein the tab is presented by the tray and the collar has a channel or slot for receiving the tab of the tray.

The foregoing description of the preferred embodiment is intended to be illustrative of the novel features of this invention. It would be appreciated by those skilled in the art, that one may make obvious departures and substitutions from this embodiment while retaining the essence of this invention. The true scope of this invention may be determined from reading the specification, including the claims, as a whole, in light of the relevant art.

What is claimed is:

1. A food package comprising, in combination:

a tray having a plurality of open top food compartments, the tray being, in plan view, substantially rectangular and having a top planar surface defining perimeter edges about the tray and borders between top openings of the compartments, each such compartment having bottom and side surfaces, the bottom surfaces lying substantially in a bottom plane parallel to the top surface of the tray, the sides of adjacent compartments being separated by predetermined spaces;

a collar surrounding the tray over the top surface, about a first perimeter edge of the top surface, covering the sides and bottom surfaces of at least a portion of two adjacent compartments and about a second perimeter edge opposite to the first perimeter edge; and an anchor which may be pressed from the collar into a space between the sides of two adjacent compartments to resist slideable displacement of the collar relative to the tray.

2. A food package according to claim 1 wherein the sides of the compartments depend downwardly from said top surface and narrow towards one another as they approach the bottom of the compartments with the space between adjacent compartment sides larger near the bottom of the compartments and attenuating towards the top surface of the tray so that said anchor frictionally engages with greater force as the anchor is pressed further into the attenuating shape of the space between adjacent food compartments.

3. A food package according to claim 1 wherein the collar is formed from a carton blank comprising:

a top panel extending over the top surface between opposed edges of the tray;

a pair of side panels extending down over a portion of the sides of the food compartments;

a bottom panel across the bottom of the tray; and first and second ends adapted to be fastened together at a joint.

4. A food package according to claim 3 wherein said first and second ends adapted to be fastened together at a joint overlap with the outside end extending from the joint to form a tab so that when the joint is placed close to the perimeter of the bottom plane of the tray the extending tab acts with the corresponding edge of the top surface of the tray to support the food package upright on its edge.

5. A package for a food product, comprising:

a tray having a plurality of recessed compartments for receiving a product;

a collar comprising a body having a cavity and an access opening to said cavity of a size and configuration to slideably receive said tray; and an anchor comprising:

a locking means presented by one of said collar or tray: and a complimentary receiving means to the locking means presented by the other of said collar or tray so that when said tray is received within said cavity of said collar the locking means and receiving means engage one another to secure said collar against further slideable displacement relative to said tray.

6. A package according to claim 5 wherein said locking means is presented by said collar and said complimentary receiving means to said locking means is presented by said tray so that when said tray is received within said cavity of said collar said locking means and said receiving means engage one another to secure said collar against further slideable displacement relative to said tray.

7. A package according to claim 6 wherein said cavity and said access opening to said cavity of said collar receive said tray along an axis parallel to parallel edges of said tray.

8. A package according to claim 7 wherein said locking means is a tab which extends stiffly inwardly of said cavity of said collar and said receiving means is a channel extending transverse to said axis parallel to said parallel edges of said tray.

9. A carton blank to form a collar for a tray having a plurality of open top food compartments, the tray being, in plan view, substantially rectangular and having a top planar surface defining perimeter edges about the tray and borders between top openings of the compartments, each such compartment having bottom and side surfaces, the bottom surfaces lying substantially in a bottom plane parallel to the top surface of the tray, the sides of adjacent compartments being separated by predetermined spaces, the carton blank comprising:

a top panel having a sufficient extent to extend over the top surface of the tray;

a pair of side panels having a sufficient extent to extend over a portion of the sides of the food compartments;

a bottom panel having a sufficient extent to extend across the bottom of the tray;

first and second ends adapted to be fastened together at a joint; and an anchor which may be pressed from the bottom panel of the collar into a space between the sides of two adjacent compartments of the tray to resist slideable displacement of the collar relative to the tray; and wherein said first and second ends when fastened together at a joint overlap with the outside end extending from the joint to form a further tab so that when the joint is placed close to the perimeter of the bottom plane of the tray the extending tab acts with the corresponding edge of the top surface of the tray to support the tray upright on its edge.

10. A carton blank according to claim 9 wherein the collar is made of cardboard so that the anchor is a stiff, cut-out tab.

11. A carton blank according to claim 9 wherein said cavity and said access opening to said cavity are of a size and configuration to slideably receive a tray having opposed parallel edges along an axis parallel to the parallel edges of the tray.

12. A carton blank according to claim 11 wherein said locking means is a tab which extends stiffly inwardly of said cavity of said collar and the receiving means is a channel extending transverse to the axis parallel to the parallel edges of the tray.

13. A carton blank according to claim 12 wherein said tab is a generally rectangular cutout within said bottom panel and foldable about one edge thereof in a direction parallel to the axis parallel to the parallel edges of the tray so as to extend inwardly of said cavity of said collar to the receiving means presented by the tray.

* * * * *